US010519528B2

(12) United States Patent
Huang et al.

(10) Patent No.: US 10,519,528 B2
(45) Date of Patent: Dec. 31, 2019

(54) LEAD-FREE, HIGH-SULPHUR AND EASY-CUTTING COPPER-MANGANESE ALLOY AND PREPARATION METHOD THEREOF

(71) Applicant: HUNAN TERRY NEW MATERIALS COMPANY LTD., Yiyang, Hunan (CN)

(72) Inventors: Jinsong Huang, Yiyang (CN); Bin Liu, Yiyang (CN); Wei Li, Yiyang (CN); Zhiyong Chen, Yiyang (CN); Tao Peng, Yiyang (CN)

(73) Assignee: HUNAN TERRY NEW MATERIALS COMPANY LTD., Hunan (CN)

( * ) Notice: Subject to any disclaimer, the term of this patent is extended or adjusted under 35 U.S.C. 154(b) by 869 days.

(21) Appl. No.: 14/898,602

(22) PCT Filed: Sep. 4, 2013

(86) PCT No.: PCT/CN2013/082961

§ 371 (c)(1),
(2) Date: Dec. 15, 2015

(87) PCT Pub. No.: WO2015/032044

PCT Pub. Date: Mar. 12, 2015

(65) Prior Publication Data

US 2016/0130685 A1 May 12, 2016

(51) Int. Cl.

| | |
|---|---|
| ***C22C 9/04*** | (2006.01) |
| ***C22C 9/05*** | (2006.01) |
| ***C22C 1/04*** | (2006.01) |
| ***B22F 3/12*** | (2006.01) |
| ***B22F 3/17*** | (2006.01) |
| ***B22F 3/20*** | (2006.01) |
| ***B22F 9/08*** | (2006.01) |
| ***C22C 9/02*** | (2006.01) |
| ***C22F 1/08*** | (2006.01) |
| ***B22F 3/16*** | (2006.01) |
| *B22F 3/24* | (2006.01) |

(52) U.S. Cl.

CPC ..... *C22C 9/04* (2013.01); *B22F 3/12* (2013.01); *B22F 3/16* (2013.01); *B22F 3/17* (2013.01); *B22F 3/20* (2013.01); *B22F 9/082* (2013.01); *C22C 1/0425* (2013.01); *C22C 9/02* (2013.01); *C22C 9/05* (2013.01); *C22F 1/08* (2013.01); *B22F 2003/175* (2013.01); *B22F 2003/208* (2013.01); *B22F 2003/248* (2013.01); *B22F 2009/0848* (2013.01); *B22F 2998/10* (2013.01); *B22F 2999/00* (2013.01)

(58) Field of Classification Search

CPC ..... C22C 9/04; B22F 3/12

See application file for complete search history.

(56) References Cited

FOREIGN PATENT DOCUMENTS

| | | | | |
|---|---|---|---|---|
| CN | 1556234 | A | | 12/2004 |
| CN | 101363086 | A | | 2/2009 |
| CN | 102634688 | A | * | 8/2012 |
| JP | 2005-133130 | A | | 5/2005 |
| JP | 2009-132986 | A | | 6/2009 |
| JP | 2012-46812 | A | | 3/2012 |

OTHER PUBLICATIONS

International Search Report, issued in PCT/CN2013/082961, dated Jul. 10, 2014.

* cited by examiner

*Primary Examiner* — Weiping Zhu

(74) *Attorney, Agent, or Firm* — Birch, Stewart, Kolasch & Birch, LLP

(57) ABSTRACT

Disclosed are a lead-free, high-sulphur and easy-cutting copper-manganese alloy and preparation method thereof. The alloy comprises the following components in percentage by weight: 52.0-95.0 wt. % of copper, 0.01-0.20 wt. % of phosphorus, 0.01-20 wt. % of tin, 0.55-7.0 wt. % of manganese, 0.191-1.0 wt. % of sulphur, one or more metals other than zinc that have an affinity to sulphur less than the affinity of manganese to sulphur, with the sum of the contents thereof no more than 2.0 wt. %, and the balance being zinc and inevitable impurities, wherein the metals other than zinc that have an affinity to sulphur less than the affinity of manganese to sulphur are nickel, iron, tungsten, cobalt, molybdenum, antimony, bismuth and niobium. The copper alloy is manufactured by a powder metallurgy method, in which after uniformly mixing the alloy powder, sulphide powder and nickel powder, pressing and shaping, sintering, re-pressing, and re-sintering are carried out to obtain the copper alloy, and the resulting copper alloy is thermally treated.

4 Claims, No Drawings

LEAD-FREE, HIGH-SULPHUR AND EASY-CUTTING COPPER-MANGANESE ALLOY AND PREPARATION METHOD THEREOF

TECHNICAL FIELD

The invention refers a metallic material and its producing process, especially a lead-free, high-sulphur and easy-cutting copper-manganese alloy and preparation method thereof

BACKGROUND ART

Lead brass can be easily machined to parts with various shapes due to their excellent performances in cold and hot workability, cutting performance and self-lubricating. Lead brass have been always recognized as an important basic metallic material and have been widely used in civilian water supply systems, electricity and the field of automotive and machinery manufacturing. Because of its wide use, large numbers of lead brass parts were abandoned, where only a few were recycled, while many small parts were abandoned. When coming in contact with the soil, lead in abandoned lead brass would enter the soil under long-term effect of rainwater and atmosphere and contaminate soil and water. When abandoned lead brass was burned as garbage, the lead vapor would enter atmosphere and greatly harm human health, so the application of the lead brass was being tightly restricted. Lead is preferred to appear as lead micro particles of simple substance on grain boundaries, neither lead-copper solid solution alloy, nor lead-copper intermetallics. In drinking water, under the effect of impurities and ions etc, lead in the lead-copper alloy will be separated out as the form ions and lead to contamination. The existing lead-copper alloy is difficult to meet the requirements of environmental laws. In order to decrease the harmful effects of lead, the corrosion mechanism of brass in drinking water and the effect on corrosion mechanism of brass when adding elements were systematically studied, and a variety of measures were taken. For example, on one hand, a small amount of tin, nickel or other annoying elements were added to improve the corrosion resistance of lead brass; on the other hand, chromium or other corrosion-resistant metals were covered on the lead-free surface of lead brass which can be obtained by removing the soluble lead from the lead brass with a certain thickness by dissolving. There is no way to eliminate the harmful effects caused by lead because of its existence in basal lead brass. The lead brass whose cutting performance is improved by lead had to gradually withdraw from the stage of history under the constraint of environmental protection laws and regulations.

Either from aspects of environmental laws and regulations all over the world or technical or economic aspects, there is no value to improve lead brass. The only way is to develop new lead-free copper alloys. The researches on metals, alloys and compounds are a long-term accumulation process, and knowledge about their characteristics is very rich for us now. It is a consensus that adding Bi, Sb, Mg, P, Si, S, Ca, Te, Se, etc to copper alloy could improve its cutting performance, while many related patents all over the world were published. It must be pointed out that compared to easy-cutting lead brass, all the easy-cutting lead-free copper alloys at present have higher cost or/and lower processing performance or/and application, such as cold and hot workability, cutting performance, anti-dezincification resistance, ammonia resistance, etc. The comprehensive performance and cost performance of lead-free copper alloy are much worse than that of lead brass. Bismuth could be used to improve the cutting performance of copper alloys, but the copper alloy with high mass fraction of bismuth is unacceptable by the market due to its high price. The copper alloys with low mass fraction of bismuth have good cutting performance, but there is still a big gap compared with lead brass. On the other hand, it is not clear so far about the effect of bismuth ion on human health, and its side effects are inconclusive, so bismuth brass is not accepted in some countries and regions. It is also doomed that bismuth could not be used as the main alternative element of lead in easy-cutting lead-copper alloys because of its limited resources. The copper alloy would have tendency of brittleness after bismuth being added, and deteriorate the pressure processing performance seriously, especially hot work performance. The recycled bismuth containing copper alloy would harm the copper processing industry, seriously decrease its value of recycling, which is unfavorable for the market promotion of easy-cutting bismuth containing copper alloys. Antimony is an element which is minimally toxic to human body. Its leaching concentration in water is severely restricted. The use of antimony brass is restricted although it has good cutting performance. It is unfavorable for the market promotion because of the less desirable hot work performance of antimony brass and the high price of antimony. Magnesium can improve cutting performance of brass obviously, but its mass fraction cannot be excessive. The elongation of Mg-brass would decrease when the mass fraction of magnesium being larger than 0.2 wt. %, and the decreasing rate will rapidly increase when increasing the mass fraction of the magnesium, which is unfavorable for the application of Mg-brass. Magnesium is a big burnt-loss element, which is a big challenge for the mass fraction control of magnesium Mg-brass. The cutting performance of brass would be improved after phosphorus being added, but its plasticity would decrease, and its tendency of hot crack would increase when being cast under low pressure. So, it would severely restrict the adding amount of phosphorus and the application of phosphorus brass. Because of high price of tin, tellurium and selenium, brass containing the tin, tellurium and selenium are difficult to be promoted widely in the market. Tin can barely improve the cutting performance of copper alloys. There are two silicon brasses among published patents. One is low-Zn silicon brass, such as C69300, which has a small market share due to its high mass fraction of copper, high density and high price. Another is the high-Zn silicon brass which has low cutting performance. Sulfur would easily pollute the surroundings when being added into the copper alloys due to its low melting point (113° C.) and low boiling point (445° C.), which cannot meet the requirements of free-pollution in today's increasingly stringent environmental regulations. Therefore, it is also extremely unfavorable for its marketing and application. In the copper alloy which does not contain manganese, sulfur usually presents in the grain boundaries in the form of low melting point eutectic. So, the copper alloy is hot brittle, and it is difficult for easy-cutting sulfur copper alloy to be hot wrought. Besides, its cost is relatively high. If sulfur or sulfides that have an affinity to sulphur less than the affinity of manganese to sulphur was added into brass fused mass, the sulfur or sulfides would react with manganese in brass fused mass and produce manganese sulfide which would float out as slag in the copper alloy fused mass, decreasing and even obliterating the cutting performance of sulfur. The mass fraction of Zn in brass is high. Zn is a typical volatile metal, and the manganese sulfide which is a product of reaction between manganese and sulfur in the brass fused mass is easily to be brought to the surface of the fused mass by gaseous Zn. Moreover, spitfire technology are usually used to degas the brass after being taken out of the furnace, which leads the reacted manganese sulfide slag to be brought to the surface of the fused mass and removed as the form of slag. This is one of the important reasons why manganese and sulfur are difficult to coexistent in cast brass. The Chinese patent 201110035313.7 indicated that the small ingot has good cutting performance in laboratory, but the requirements which is mentioned according to claim 3: "adding Zn quickly, then immediately casting into ingots" cannot be met in the industrial massive manufacturing. The cutting performance of manganese sulfide product decreases rapidly with the duration of copper alloys fused mass in the furnace, even disappears at last. Furthermore, with increase of the mass fraction of the sulfur, manganese sulfide product increases and the corresponding slag float faster, and its cutting performance decreases more rapidly. According to the easy-cutting mechanism for copper-manganese alloy sulfide, under the condition without significantly deterioration of the process and application of copper alloy, the higher the mass fraction of sulfur is, the more the manganese sulfides are produced, and the better the cutting performance of copper alloy is. But when copper alloys were cast, the manganese sulfides float from the fused mass more easily, and its effect of improving cutting performance decreases more rapidly. It could be concluded that high-sulfur copper-manganese alloy could not be produced by casting. The method of multi-element alloy was used mostly to improve the cutting performance of copper alloys, for example, the combinative elements were added into copper alloys. But in practice, it is proved that adding many elements which could improve the cutting performance is not an ideal way. On one hand, the interaction between the elements could decrease the cutting performance of copper alloys. On the other hand, the copper alloy would be strengthened by combinative elements adding, which would increase the strength and hardness of the copper alloy, and decrease the performances of pressure processing and the machine work of copper alloys. Besides, adding too many rare and expensive elements would increase the cost of copper alloys, which is also unfavorable for its marketing and application. There are still limitations in adding combinative elements to improve processing and application of copper alloys.

The lead-copper alloys were often used as self-lubricating bearing which contain oil, but they doomed to be replaced. Graphite is also added to the copper alloy because graphite has excellent lubricating ability and it is one of the widely used lubricants. Just like lead, graphite is hardly solid-soluble in copper, and its interface with copper is mechanical engagement rather than metallurgical bonding, resulting in low interfacial strength, which results in low strength of graphite self-lubricating bearings, and it cannot meet the requirements in heavy-duty and high-speed environment.

There is an urgent need for a new lead-free, easy-cutting copper alloy, which not only have excellent processing such as cutting performance, hot forging, polishing and plating, but also have excellent application such as high strength, anti-dezincification resistance, ammonia resistance and self-lubricating properties. The present invention has been developed under these considerations.

DISCLOSURE OF THE INVENTION

The invention is aimed to provide a high-performance lead-free easy-cutting copper alloy and its preparation method thereof. Unless otherwise noted, the components in this application refer to the components in percentage by weight. The alloy comprises the components in percentage by weight are as follows: Cu 52.0-95.0 wt. %, P 0.001-0.20 wt. %, Sn 0.01-20 wt. %, Mn 0.55-7.0 wt. %, S 0.191-1.0 wt. %, one or more metals other than Zn that have an affinity to sulphur less than the affinity of manganese to sulphur, with the sum of the contents thereof not more than 2.0 wt. % , and the balance being Zn and inevitable impurities, where Pb is not more than 0.05 wt. %.

The metals other than Zn that have an affinity to sulphur less than the affinity of manganese to sulphur are Ni, Fe, W, Co, Mo, Sb, Bi and Nb.

As the optimization of the present invention, the alloy comprises the following components in percentage by weight are Cu 54.0-68.0 wt. %, P 0.001-0.15 wt. %, Sn 0.01-1 wt. %, Mn 1.5-4.0 wt. %, S 0.2-0.6 wt. %, one or more metals chosen from Ni, Fe, W, Co, Mo, Sb, Bi and/or Nb, with the sum of not more than 1.8 wt. %, and the balance being Zn and inevitable impurities, where Pb is not more than 0.05 wt. %.

Further, the alloy comprises the following components in percentage by weight are Cu 56.0-64.0 wt. %, P 0.001-0.12 wt. %, Sn 0.01-0.8 wt. %, Mn 2.0-3.5 wt. % and S 0.22-0.40 wt. %, one or more metals chosen from Ni, Fe, W, Co, Mo, Sb, Bi and/or Nb, with the sum of not more than 1.5 wt. %, and the balance being Zn and inevitable impurities, where Pb is not more than 0.05 wt. %.

Further, the alloy comprises the following components in percentage by weight are Cu 57.0-62.0 wt. %, P 0.001-0.12 wt. %, Sn 0.01-0.6 wt. %, Mn 2.0-3.5 wt. %, S 0.22-0.40 wt. %, Ni 0.1-1.2 wt. %, and the balance being Zn and inevitable impurities, where Pb is not more than 0.05 wt. %.

Further, the alloy comprises the following components in percentage by weight are Cu 57.0-62.0 wt. %, P 0.001-0.08 wt. %, Sn 0.01-0.4 wt. %, Mn 2.0-3.5 wt. %, S 0.22-0.30 wt. %, Ni 0.1-0.5 wt. %, and the balance being Zn and inevitable impurities, where Pb is not more than 0.05 wt. %.

The alloy comprises the following components in percentage by weight are Cu 74-90 wt. %, P 0.001-0.12 wt. %, Sn 5-20 wt. %, Mn 2.5-3.5 wt. %, S 0.2-1.0 wt. %, one or more metals chosen from Ni, Fe, W, Co, Mo, Sb, Bi and/or Nb, with the sum of not more than 2.0 wt. %, and the balance being Zn and inevitable impurities, where Pb is not more than 0.05 wt. %.

Further, the alloy comprises the following components in percentage by weight are Cu 84-90 wt. %, P 0.001-0.12 wt. %, Sn 5-11 wt. %, Mn 2.5-3.5 wt. %, S 0.3-1.0 wt. %, one or more metals chosen from Ni, Fe, W, Co, Mo, Sb, Bi and/or Nb, with the sum of not more than 1.5 wt. %, and the balance being Zn and inevitable impurities, where Pb is not more than 0.05 wt. %.

Further, the alloy comprises the following components in percentage by weight are Cu 84-90 wt. %, P 0.001-0.12 wt. %, Sn 5-11 wt. %, Mn 2.5-3.5 wt. %, S 0.4-0.8 wt. %, Ni 0.1-1.2 wt. %, and the balance being Zn and inevitable impurities, where Pb is not more than 0.05 wt. %.

Further, the alloy comprises the following components in percentage by weight are Cu 84-90 wt. %, P 0.001-0.12 wt. %, Sn 5-11 wt. %, Mn 2.5-3.5 wt. %, S 0.4-0.7 wt. %, Ni 0.1-0.5 wt. %, and the balance being Zn and inevitable impurities, where Pb is not more than 0.05 wt. %.

When the mass fraction of tin is less than 5 wt. %, the process of the invented lead-free easy-cutting copper alloy is as follows:

Cu, Sn, Mn, P and Zn were melted sequentially, followed by uniformly distributed, then the alloy elements were made into copper-manganese alloy powder using water or gas atomization, or Cu, Sn, P and Zn were melted sequentially, followed by uniformly distributed, then the alloy elements were made into copper alloy powder which does not contain manganese using water or gas atomization;

nickel powder, copper-manganese alloy powder and one or more kinds of sulfides of metals that have an affinity to sulphur less than the affinity of manganese to sulphur were mixed, or nickel powder, copper alloy powder which does not contain manganese, manganese powder and one or more kinds of sulfides of metals that have an affinity to sulphur less than the affinity of manganese to sulphur were mixed;

then the forming agent was added by 0.5-1.5 wt. % to above mixture, all the configured powders were put into the mixer to mix for 0.4-5 h to make the powders uniformly distributed;

the uniformly mixed powders obtained by above step were molded by compression, then sintered with the following sintering process: the said mixed powders were heated from room temperature to the sintering temperature of 680-780° C. within 1-5 h to remove the forming agent, then held at 680-780° C. for 30-120 minutes, where the sintering atmosphere is a reducing atmosphere or an inert atmosphere;

the sintered copper alloy was treated by cold re-press at 500-800 MPa, or by cold-forge on the punching machine with fast-moving punch at 200-400 MPa, and then re-sintered with the following re-sintered process: the alloy were heated from room temperature to the sintering temperature of 820-870° C. for 1-3 h, then held at 820-870° C. for 30-120 minutes, where the sintering atmosphere is a reducing atmosphere or an inert atmosphere;

the re-pressed and re-sintered copper alloy was thermally treated at the temperature of 800-870° C.

The said metal sulfides are solid metal sulfides.

The said metal sulfides are eleven kinds of metal sulfides of Fe, Co, Ni, Sn, W, Mo, Nb, Cu, Zn, Sb and Bi.

The said metal sulfides are CuS, $Cu_2S$, ZnS, SnS, NiS, $Fe_2S_3$, $FeS_2$, FeS, $WS_2$, CoS, $MoS_2$, $MoS_3$, $Sb_2S_4$, $Sb_2S_5$, $Sb_2S_3$, $Bi_2S_3$, $NbS_2$ and $NbS_3$.

The said metal sulfides are preferred to be copper sulfide, Zn sulfide and iron sulfide.

The said hot work is hot die forging or hot extrusion.

When the mass fraction of tin is not less than 5 wt. %, the process of the lead-free easy-cutting copper alloy is as follows:

Cu, Sn, Mn and Zn were melted sequentially, then, after uniformly distributed, the alloy elements were made into copper-manganese alloy powder using water or gas atomization, or Cu, Sn and Zn were melted sequentially, then, after uniformly distributed, the alloy elements were made into copper alloy powder which does not contain manganese using water or gas atomization;

nickel powder, copper-manganese alloy powder and one or more kinds of sulfides of metals that have an affinity to sulphur less than the affinity of manganese to sulphur were mixed, or nickel powder, copper alloy powder which does not contain manganese, manganese powder and one or more kinds of sulfides of metals that have an affinity to sulphur less than the affinity of manganese to sulphur were mixed;

then the forming agent was added by 0.5-1.5 wt. % to above mixture and was mixed for 0.4-5 h to make the powders uniformly distributed;

the uniformly mixed powders obtained by above step were molded by compression, then sintered with the following sintering process: the said mixed powders were heated from room temperature to the sintering temperature of 730-770° C. within 1-5 h to remove the forming agent, then held at 730-770° C. for 30-120 minutes, where the sintering atmosphere is a reducing atmosphere or an inert atmosphere.

The said forming agent is paraffin powder or zinc stearate powder.

Samples for tests of tensile strength, cutting performance, anti-dezincification corrosion and ammonia resistance stress corrosion were sampled from the hot extrusion rods. Tests of flexural strength, elongation were carried out by sampling from the sintered tin-copper based self-lubricating copper alloy. Samples for wear tests were sampled from the sintered tin-copper based self-lubricating copper alloy and should be soaked in hot oil at 90° C. for 1 h before test.

The solubility of lead in the molten copper is large, but the solubility is almost zero in solid copper alloy at room temperature. When molten lead brass was solidified, the lead dispersed in the grain boundaries of brass as micro spherical particles, sometimes inside the crystalloid. Lead is brittle and soft with melting point of only 327.5° C. The friction heat resulted from cutting of the lead brass would further soften the lead particles. When the lead brass was cut, the dispersed lead particles corresponded to holes existed in the brass, which could lead to stress concentration, and resulted in the so-called notch effect, consequently the chip here is easy to break. Furthermore, in the contact part of blade and chips, lead could be instantly melted due to the heat resulted from cutting work, which contributes to change the shape of chips and lubricate the cutting tool to minimize the abrasion of the blade. Thus, the lead plays a role in the shape change of chip, splinter of chip, reduction of bonding and welding as well as improvement of the cutting speed during cutting process of easy-cutting brass. It could greatly increase the cutting efficiency, increase working life of the cutting tools and decrease roughness of the surface to smoothen the cutting surface. The characteristics and its state of being in easy-cutting copper alloy made lead to play a decisive role in the cutting performance. Lead in the self-lubricating lead-copper alloy also plays a role in the reduction of friction because it is soft and brittle. The operation mechanism of graphite in graphite self-lubricating copper alloy is similar to the lead. In the invention, manganese and metal sulfides were both added to the copper alloy. During the sintering process, the activity of manganese is higher than the metal(s) in the added metal sulfides, so the added sulfides react with manganese and produce manganese sulfides or a mixture of manganese sulfide and other sulfides. The sulfide resulted sulfide in situ is mainly manganese sulfide, and its bonding with copper alloy grains is typically metallurgical bonding, with the interface of coherent or semi-coherent and high strength. The resulted sulfide in situ has layer structure. Its structure is similar to that of graphite, while it is also soft and smooth. Manganese sulfide in copper alloy corresponds to holes in the copper alloy, making stress tends to concentrate here, which results the so-called notch effect, and makes the chips here break easily. The mechanism of chip breaking of manganese sulfide is the same as that of lead in lead-copper alloy. Since the produced particles of sulfides have lubricating effect on cutting tool, and can also decrease abrasion of the cutter head, it can greatly increases the cutting efficiency. The resulted manganese sulfide particles bond well with copper alloy grains, along with clean interface and high bonding strength. However, the graphite particles in the graphite self-lubricating copper alloy do not have such advantages. As a result, self-lubricating copper alloys not only have good lubrication but also have higher strength than those in graphite self-lubrication copper alloys.

It is generally believed that phosphorus plays a role of deoxidation. It can improve the casting and welding performances of the copper alloys, decrease the loss of beneficial elements such as silicon, tin and magnesium and refine the grains of brass. In the present invention, the mass fraction of added phosphorus is controlled in 0.001-0.20 wt. %, and the phosphorus is mainly used to decrease the melting point of the copper alloy powder in the sintering process to activate the sintering.

Advantages of the invention: the lead-free, high-sulfur and easy cutting manganese copper alloy has not only excellent process performances such as cutting and hot forging but also excellent applications such as high strength, anti-dezincification, ammonia resistance, burnishing, electroplating and self-lubricating. The brass after re-pressed and re-sintered has good performance of hot forging, hot extrusion and other hot working performances. The hot extruded brass has good cutting performance and high strength. According to 1S06509: 1981 "Corrosion of Metals and Alloys-determination of Anti-dezincification Resistant Corrosion of Brass", the hot extruded brass has high anti-dezincification performance. According to GB/T10567.2-2007"Wrought Copper and Copper Alloys-Detection of Residual Stress-ammonia Test", when the concentration of the ammonia is 14%, the maximal hours that the brass exposed to fumes of ammonia without cracks is 16 hours. The bending strength and elongation of the copper-tin alloy based self-lubricating copper alloy of the invention equivalent up to 111% and 116% of that of graphite self-lubricating copper alloy, respectively. The composition of copper alloy is simple, and it does not contain harmful element such as lead, cadmium, mercury and arsenic while there is no pollution in its producing process. Copper alloy of the invention does not contain chromium, and can be produced without bismuth, antimony or other elements by alloy design, which can meet the stringent requirements of leaching of harmful elements in the bathroom and plumbing industry.

BEST MODES FOR CARRYING OUT THE INVENTION

Example 1

The copper alloy comprises the following components in percentage by weight are as follows: Cu 54.0 wt. %, P 0.11 wt. %, Sn 0.011 wt. %, Mn 0.6 wt. %, and the balance being Zn and inevitable impurities. The mass fraction of powders is as follows: sulfide powder is a mixture of copper sulfide powder and Zn sulfide powder with the mass fraction of 0.80 wt. % and 0.30 wt. %, respectively; the mass fraction of nickel powder is 2.0 wt. %; the mass fraction of forming agent of paraffin powder is 0.5 wt. %; the balance is the said copper-manganese alloy powder. The mixing time of powders is 4.0 h. The uniformly mixed powders were molded by compression and then sintered in the sintering furnace. The sintering process is as follows: the said mixed powders were heated from room temperature to 680° C. within 5 h to remove forming agent, then held at 680° C. for 100 minutes, and the sintering atmosphere was an inert atmosphere. Then it was cooled to room temperature through water. The sintered brass rod was re-pressed at 500 MPa and then re-sintered. The re-sintered process is as follows: the rod was heated from room temperature to 820° C. within 3 h, then held at 820° C. for 120 minutes, and the sintering atmosphere is an inert atmosphere. The re-sintered brass was hot extruded at 800° C. with the hot extrusion ratio of 120. Samples for tests of tensile strength, cutting performance, anti-dezincification corrosion and ammonia resistance stress corrosion were sampled from the hot extrusion rods. The results indicated that the cutting ability of copper alloy is equivalents to 77% of that of lead brass, with tensile strength of 599.0 MPa, yield strength of 329.5 MPa, average thickness of dezincification corrosion layer is 192.2 μm, maximum dezincification layer thickness of 329.9 μm and no cracks appeared after exposed to fumes of ammonia for 16 hours.

Example 2-Example 33

The chemical compositions of the copper alloy powders in example 2-33 are listed in Table 1. The mass fractions of powders in example 2-33 are listed in Table 2. Process parameters in example 2-33 are listed in Table 3. Properties of the copper alloys in example 2-33 are listed in Table 4.

Example 34

The mass fractions of the copper-manganese alloy powder is as follows: Cu 88.0 wt. %, Sn 10.0 wt. %, Mn 1.5 wt. %, and the balance being Zn and inevitable impurities. The mass fractions of powders are as follows: sulfide powder is a mixture of CuS, $Cu_2S$, ZnS, SnS, NiS powders with the mass fraction of each sulfide of 0.2 wt. %. The mass fraction of nickel powder is 0.3 wt. %. The mass fraction of forming agent of paraffin powder is 1.2 wt. %. The balance is said copper-manganese alloy powder. The mixing time of powders is 2.0 h. The mixed powders were molded by compression and then sintered in the sintering furnace. The sintering process is as follows: the said mixed powders were heated from room temperature to the sintering temperature of 750° C. within 2 h to remove forming agent, then held at 750° C. for 60 minutes, and the sintering atmosphere is a reducing atmosphere. Then it is cooled to room temperature through water. The samples for friction and wear were soaked for 1 h in the hot oil of at 90° C. The results indicated that the friction coefficient of lead-free self-lubricating copper alloy is equivalent to 96% of that of graphite self-lubricating copper alloy, and its wear loss is equivalent to 95% of graphite self-lubricating copper alloy. The results of mechanical properties indicated that tensile strength and elongation of the lead-free self-lubricating copper alloy are equivalent to 110% and 116% of that of graphite self-lubricating copper alloy, respectively.

Example 35-42

The chemical compositions of the copper alloy powders in example 35-42 are listed in Table 1. The mass fractions of the powders in example 35-42 are listed in Table 2. Process parameters of copper alloy in example 35-42 are listed in Table 3. The friction and wear samples in example 35-42 were soaked in hot oil of 90° C. for 1 h, where the corresponding properties of the copper alloys are listed in Table 5.

TABLE 1

Chemical composition of copper alloy powder in all examples

| Example | Cu/% | Mn/% | P/% | Sn/% | Zn/% |
|---|---|---|---|---|---|
| 1 | 54.0 | 0.6 | 0.11 | 0.011 | Balance |
| 2 | 54.0 | 1.5 | 0.12 | 0.012 | Balance |

TABLE 1-continued

Chemical composition of copper alloy powder in all examples

| Example | Cu/% | Mn/% | P/% | Sn/% | Zn/% |
|---|---|---|---|---|---|
| 3 | 54.0 | 3.5 | 0.13 | 0.013 | Balance |
| 4 | 54.0 | 7.0 | 0.09 | 0.014 | Balance |
| 5 | 59.0 | 5.0 | 0.12 | 0.015 | Balance |
| 6 | 59.0 | 3.0 | 0.08 | 0.016 | Balance |
| 7 | 59.0 | 2.5 | 0.16 | 0.017 | Balance |
| 8 | 59.0 | 1.5 | 0.10 | 0.018 | Balance |
| 9 | 64.0 | — | 0.15 | 0.019 | Balance |
| 10 | 64.0 | — | 0.12 | 0.011 | Balance |
| 11 | 64.0 | — | 0.11 | 0.011 | Balance |
| 12 | 64.0 | — | 0.09 | 0.011 | Balance |
| 13 | 70.0 | — | 0.15 | 0.011 | Balance |
| 14 | 70.0 | — | 0.12 | 0.011 | Balance |
| 15 | 70.0 | — | 0.14 | 0.011 | Balance |
| 16 | 70.0 | — | 0.12 | 0.011 | Balance |
| 17 | 52.0 | 0.5 | 0.05 | 0.011 | Balance |
| 18 | 54.0 | 1.5 | 0.05 | 0.011 | Balance |
| 19 | 54.0 | 3.5 | 0.05 | 0.011 | Balance |
| 20 | 54.0 | 7.0 | 0.05 | 0.011 | Balance |
| 21 | 59.0 | 5.0 | 0.05 | 0.011 | Balance |
| 22 | 59.0 | 3.0 | 0.05 | 0.011 | Balance |
| 23 | 59.0 | 2.5 | 0.05 | 0.011 | Balance |
| 24 | 59.0 | 1.5 | 0.05 | 0.011 | Balance |
| 25 | 64.0 | — | 0.05 | 0.011 | Balance |
| 26 | 64.0 | — | 0.05 | 0.011 | Balance |
| 27 | 64.0 | — | 0.05 | 0.011 | Balance |
| 28 | 64.0 | — | 0.09 | 0.011 | Balance |
| 29 | 70.0 | — | 0.05 | 0.011 | Balance |
| 30 | 70.0 | — | 0.05 | 0.011 | Balance |
| 31 | 80.0 | — | 0.04 | 0.011 | Balance |
| 32 | 88.0 | — | 0.03 | 0.011 | Balance |
| 33 | 58.0 | 6.0 | 0.03 | 0.011 | Balance |
| 34 | 88 | 1.5 | — | 10.0 | Balance |
| 35 | 88 | 1.0 | — | 9.0 | Balance |
| 36 | 88 | 0.6 | — | 11.0 | Balance |
| 37 | 88 | 1.5 | — | 10.0 | Balance |
| 38 | 77 | 0.6 | — | 20.0 | Balance |
| 39 | 77 | 1.0 | — | 19.0 | Balance |
| 40 | 77 | 1.0 | — | 21.0 | Balance |
| 41 | 77 | — | — | 20.0 | Balance |
| 42 | 88 | 1.0 | — | 5.5 | Balance |

— indicates no element added.

TABLE 2

The mass fractions of powders in all examples

| Example | The sulfide | Ni powder | Binders added | Mn powder | Copper alloy powder |
|---|---|---|---|---|---|
| 1 | CuS0.80, ZnS0.30 | 2.0 | 0.5 | — | Balance |
| 2 | ZnS0.40, $FeS_2$0.10, $MoS_3$0.10 | 1.8 | 1.5 | — | Balance |
| 3 | Mixed powder of CuS.0.1, $Sb_2S_4$0.1, $Sb_2S_5$0.1, $Sb_2S_3$0.1, $Bi_2S_3$0.1, $NbS_2$0.1, $Nb_2S_3$0.30 | 1.2 | 0.8 | — | Balance |

TABLE 2-continued

The mass fractions of powders in all examples

| Example | The sulfide | Ni powder | Binders added | Mn powder | Copper alloy powder |
|---|---|---|---|---|---|
| 4 | NiS0.30, ZnS0.30 | 0.8 | 1.0 | — | Balance |
| 5 | SnS0.40, ZnS0.60 | 0.3 | 0.6 | — | Balance |
| 6 | $Cu_2$S1.50, ZnS0.60 | 0.3 | 1.0 | — | Balance |
| 7 | ZnS1.20 | 0.3 | 1.2 | — | Balance |
| 8 | CuS1.00, ZnS0.30 | 0.3 | 0.9 | — | Balance |
| 9 | $Fe_2S_3$0.80, Zn0.30 | 0.3 | 1.2 | 3.0 | Balance |
| 10 | FeS0.70, ZnS0.30 | 0.3 | 1.2 | 2.0 | Balance |
| 11 | WS1.80, ZnS0.30 | 0.3 | 0.8 | 1.0 | Balance |
| 12 | CoS2.00, ZnS0.30 | 0.3 | 1.2 | 3.0 | Balance |
| 13 | $MoS_2$1.80, ZnS0.30 | 0.2 | 1.0 | 2.0 | Balance |
| 14 | Mixed powder of WS0.30, $Fe_2S_3$0.30, CuS0.30 | 0.2 | 1.2 | 2.0 | Balance |
| 15 | Mixed powder of SnS0.10, NiS0.10, $Fe_2S_3$0.10, FeS0.10, WS0.10, CoS0.10, $MoS_2$0.10, CuS0.10, ZnS0.30 | 0.2 | 1.1 | 3.5 | Balance |
| 16 | Mixed powder of CuS0.20, $Cu_2$S0.20, ZnS0.20, SnS0.20, NiS0.20, $Fe_2S_3$0.20, FeS0.20 | 0.2 | 1.2 | 3.5 | Balance |
| 17 | CuS0.60, ZnS.30 | 0.3 | 0.5 | — | Balance |
| 18 | CuS1.07, ZnS0.30 | 0.8 | 1.5 | — | Balance |
| 19 | CuS1.55, ZnS0.30 | 0.8 | 0.8 | — | Balance |
| 20 | CuS2.03, ZnS0.30 | 0.3 | 1.0 | — | Balance |
| 21 | CuS0.60, ZnS0.30 | 0.5 | 0.6 | — | Balance |
| 22 | CuS1.07, ZnS0.30 | 0.1 | 1.0 | — | Balance |
| 23 | CuS1.55, ZnS0.30 | 0.1 | 1.2 | — | Balance |
| 24 | CuS2.03, ZnS0.30 | 0.5 | 0.9 | — | Balance |
| 25 | CuS0.60, ZnS0.30 | 0.1 | 1.2 | 3.0 | Balance |
| 26 | CuS1.07, ZnS0.30 | 0.5 | 1.2 | 2.0 | Balance |
| 27 | CuS1.55, ZnS0.30 | 0.5 | 0.8 | 1.0 | Balance |
| 28 | CuS2.03, ZnS0.30 | 0.1 | 1.2 | 3.0 | Balance |
| 29 | CuS0.60, ZnS0.30 | 0.8 | 1.0 | 2.0 | Balance |
| 30 | CuS1.07, ZnS0.30 | 0.3 | 1.2 | 2.0 | Balance |
| 31 | CuS1.55, ZnS0.30 | 0.3 | 1.1 | 3.5 | Balance |
| 32 | CuS2.03, ZnS0.30 | 0.8 | 1.2 | 3.5 | Balance |
| 33 | ZnS0.90 | 0.3 | 0.5 | — | Balance |
| 34 | Mixed powder of CuS0.20, $Cu_2$S0.20, ZnS0.20, SnS0.20, NiS0.20 | 0.3 | 1.2 | — | Balance |
| 35 | ZnS1.00 | 0.3 | 1.1 | — | Balance |
| 36 | ZnS1.40 | 0.3 | 1.0 | — | Balance |
| 37 | NiS0.50, ZnS0.30 | 0.3 | 1.2 | — | Balance |
| 38 | CuS1.00, ZnS0.30 | 0.3 | 1.1 | — | Balance |
| 39 | WS1.80, ZnS0.30 | 0.3 | 1.2 | — | Balance |
| 40 | $Fe_2S_3$2.00, ZnS0.30 | 0.3 | 1.0 | — | Balance |
| 41 | $MoS_2$1.00, ZnS0.30 | 0.3 | 0.9 | 0.6 | Balance |
| 42 | CuS1.55, ZnS0.30 | 0.3 | 0.6 | — | Balance |

— indicates no powder added

TABLE 3

Producing parameters of copper alloys in all examples

| Example | Mixing time/h | Sintering temperature/° C. | Heating time/h | Holding time/min | Sintering atmosphere | Re-sintering temperature/° C. |
|---|---|---|---|---|---|---|
| 1 | 4 | 680 | 5 | 100 | Inert | 820 |
| 2 | 2 | 680 | 3 | 100 | Inert | 840 |
| 3 | 4 | 680 | 5 | 100 | Reducing | 860 |
| 4 | 2 | 680 | 5 | 100 | Reducing | 870 |
| 5 | 4 | 680 | 2 | 100 | Reducing | 860 |
| 6 | 3 | 680 | 3 | 100 | Reducing | 860 |

TABLE 3-continued

Producing parameters of copper alloys in all examples

| | | | | | | |
|---|---|---|---|---|---|---|
| 7 | 4 | 680 | 2 | 100 | Reducing | 860 |
| 8 | 2 | 680 | 2 | 100 | Reducing | 860 |
| 9 | 3 | 730 | 2 | 80 | Reducing | 860 |
| 10 | 1 | 730 | 2 | 80 | Reducing | 860 |
| 11 | 2 | 730 | 2 | 80 | Reducing | 860 |
| 12 | 1 | 730 | 2 | 80 | Reducing | 860 |
| 13 | 2 | 780 | 1 | 60 | Reducing | 860 |
| 14 | 2 | 780 | 2 | 60 | Reducing | 860 |
| 15 | 3 | 780 | 2 | 60 | Reducing | 860 |
| 16 | 2 | 780 | 2 | 60 | Reducing | 860 |
| 17 | 4 | 680 | 5 | 100 | Reducing | 860 |
| 18 | 2 | 680 | 3 | 100 | Reducing | 860 |
| 19 | 4 | 680 | 5 | 100 | Reducing | 860 |
| 20 | 2 | 680 | 5 | 100 | Reducing | 860 |
| 21 | 4 | 680 | 1 | 100 | Reducing | 860 |
| 22 | 3 | 680 | 3 | 100 | Reducing | 860 |
| 23 | 4 | 680 | 2 | 100 | Reducing | 860 |
| 24 | 2 | 680 | 2 | 100 | Reducing | 860 |
| 25 | 3 | 680 | 2 | 100 | Reducing | 860 |
| 26 | 1 | 680 | 4 | 100 | Reducing | 860 |
| 27 | 2 | 680 | 2 | 100 | Reducing | 860 |
| 28 | 1 | 680 | 4 | 100 | Reducing | 860 |
| 29 | 2 | 680 | 2 | 100 | Reducing | 860 |
| 30 | 2 | 680 | 2 | 100 | Reducing | 860 |
| 31 | 3 | 680 | 2 | 100 | Reducing | 860 |
| 32 | 2 | 680 | 2 | 100 | Reducing | 860 |
| 33 | 2 | 780 | 3 | 100 | Reducing | 870 |
| 34 | 2 | 750 | 2 | 60 | Reducing | — |
| 35 | 2 | 740 | 2 | 90 | Reducing | — |
| 36 | 3 | 730 | 2 | 120 | Reducing | — |
| 37 | 2 | 770 | 2 | 45 | Reducing | — |
| 38 | 3 | 740 | 2 | 75 | Reducing | — |
| 39 | 2 | 730 | 2 | 90 | Reducing | — |
| 40 | 2 | 760 | 2 | 45 | Reducing | — |
| 41 | 2 | 750 | 2 | 60 | Reducing | — |
| 42 | 2 | 760 | 2 | 90 | Reducing | — |

| Example | Heating time/h | Holding time/min | Sintering atmosphere | Re-pressing pressure/MPa | Cold die forging pressure/MPa | Hot extrusion temperature/° C. |
|---|---|---|---|---|---|---|
| 1 | 3 | 120 | Inert | 500 | — | 800 |
| 2 | 2 | 105 | Inert | 600 | — | 810 |
| 3 | 2 | 60 | Reducing | 800 | — | 820 |
| 4 | 1 | 30 | Reducing | 700 | — | 830 |
| 5 | 2 | 90 | Reducing | 700 | — | 840 |
| 6 | 2 | 90 | Reducing | 700 | — | 850 |
| 7 | 2 | 90 | Reducing | 700 | — | 860 |
| 8 | 2 | 90 | Reducing | 700 | — | 870 |
| 9 | 2 | 90 | Reducing | 700 | — | 830 |
| 10 | 2 | 90 | Reducing | 700 | — | 830 |
| 11 | 2 | 90 | Reducing | 700 | — | 830 |
| 12 | 2 | 90 | Reducing | 700 | — | 830 |
| 13 | 2 | 90 | Reducing | 700 | — | 830 |
| 14 | 2 | 90 | Reducing | 700 | — | 830 |
| 15 | 2 | 90 | Reducing | 700 | — | 830 |
| 16 | 2 | 90 | Reducing | — | 200 | 830 |
| 17 | 2 | 90 | Reducing | — | 300 | 830 |
| 18 | 2 | 90 | Reducing | — | 400 | 830 |
| 19 | 2 | 90 | Reducing | — | 300 | 830 |
| 20 | 2 | 90 | Reducing | — | 300 | 830 |
| 21 | 2 | 90 | Reducing | — | 300 | 830 |
| 22 | 2 | 90 | Reducing | — | 300 | 830 |
| 23 | 2 | 90 | Reducing | — | 300 | 830 |
| 24 | 2 | 90 | Reducing | — | 300 | 830 |
| 25 | 2 | 90 | Reducing | — | 300 | 830 |
| 26 | 2 | 90 | Reducing | — | 300 | 830 |
| 27 | 2 | 90 | Reducing | — | 300 | 830 |
| 28 | 2 | 90 | Reducing | — | 300 | 830 |
| 29 | 2 | 90 | Reducing | — | 300 | 830 |
| 30 | 2 | 90 | Reducing | — | 300 | 830 |
| 31 | 2 | 90 | Reducing | — | 300 | 830 |
| 32 | 2 | 90 | Reducing | — | 300 | 830 |
| 33 | 2 | 90 | Reducing | — | 400 | 800 |
| 34 | — | — | — | — | — | — |
| 35 | — | — | — | — | — | — |
| 36 | — | — | — | — | — | — |

TABLE 3-continued

| Producing parameters of copper alloys in all examples | | | | | | |
|---|---|---|---|---|---|---|
| 37 | — | — | — | — | — | — |
| 38 | — | — | — | — | — | — |
| 39 | — | — | — | — | — | — |
| 40 | — | — | — | — | — | — |
| 41 | — | — | — | — | — | — |
| 42 | — | — | — | — | — | — |

— indicates no process

TABLE 4

| Performances in example 1-33 | | | | | | | |
|---|---|---|---|---|---|---|---|
| Example | Hot extrusion ratio | Corresponding cutting ability of lead brass/% | Tensile strength/MPa | Yielding strength/MPa | Average dezincification layer thickness/μm | Maximum dezincification layer thickness/μm | Time without cracks after exposed in fumes of ammonia/h |
| 1 | 120 | 77 | 599.0 | 329.5 | 192.2 | 329.9 | 16 |
| 2 | 120 | 82 | 624.0 | 331.7 | 168.4 | 296.6 | 16 |
| 3 | 120 | 86 | 574.1 | 313.8 | 195.7 | 338.1 | 16 |
| 4 | 126 | 80 | 554.1 | 299.5 | 182.6 | 321.5 | 16 |
| 5 | 120 | 85 | 614.0 | 336.4 | 176.3 | 310.4 | 16 |
| 6 | 120 | 88 | 604.0 | 328.9 | 144.5 | 257.2 | 16 |
| 7 | 120 | 86 | 439.3 | 241.2 | 197.3 | 341.8 | 8 |
| 8 | 110 | 85 | 429.3 | 223.1 | 200.5 | 343.7 | 8 |
| 9 | 110 | 83 | 579.2 | 315.3 | 181.1 | 318.3 | 16 |
| 10 | 110 | 84 | 603.9 | 332.1 | 188.8 | 329.8 | 16 |
| 11 | 110 | 83 | 588.7 | 311.2 | 174.9 | 307.6 | 16 |
| 12 | 110 | 84 | 579.4 | 308.2 | 173.0 | 304.9 | 16 |
| 13 | 110 | 85 | 574.5 | 304.9 | 168.4 | 299.2 | 16 |
| 14 | 110 | 83 | 539.3 | 277.1 | 178.0 | 307.6 | 16 |
| 15 | 110 | 83 | 479.6 | 253.7 | 198.9 | 341.2 | 8 |
| 16 | 110 | 87 | 449.9 | 229.5 | 202.1 | 349.5 | 8 |
| 17 | 100 | 87 | 664.9 | 354.2 | 154.3 | 476.4 | 16 |
| 18 | 100 | 82 | 458.5 | 215.7 | 196.2 | 457.8 | 16 |
| 19 | 100 | 86 | 583.5 | 290.8 | 180.4 | 258.9 | 16 |
| 20 | 100 | 80 | 426.0 | 202.3 | 234.8 | 398.4 | 8 |
| 21 | 100 | 85 | 516.5 | 237.2 | 189.4 | 301.8 | 16 |
| 22 | 100 | 88 | 609.6 | 337.7 | 179.9 | 293.1 | 6 |
| 23 | 100 | 86 | 454.1 | 219.1 | 169.5 | 341.8 | 16 |
| 24 | 100 | 85 | 391.2 | 220.7 | 176.6 | 230.6 | 16 |
| 25 | 100 | 83 | 613.1 | 300.9 | 190.7 | 386.9 | 16 |
| 26 | 75 | 84 | 579.4 | 347.0 | 162.6 | 205.1 | 16 |
| 27 | 100 | 83 | 657.7 | 353.2 | 167.0 | 296.0 | 10 |
| 28 | 100 | 84 | 355.1 | 137.7 | 191.2 | 371.6 | 16 |
| 29 | 100 | 85 | 375.8 | 155.2 | 203.6 | 317.8 | 12 |
| 30 | 100 | 83 | 403.8 | 174.8 | 156.7 | 250.9 | 16 |
| 31 | 100 | 83 | 363.7 | 150.7 | 208.0 | 337.8 | 16 |
| 32 | 100 | 87 | 377.2 | 185.9 | 193.3 | 321.5 | 16 |
| 33 | 100 | 89 | 676.3 | 359.8 | 140.1 | 199.8 | 16 |

TABLE 5

| Performances in example 34-42 | | | | |
|---|---|---|---|---|
| Example | Corresponding friction coefficient of graphite self-lubricating copper alloys/% | Corresponding wear loss of graphite self-lubricating copper alloys/% | Corresponding tensile strength of graphite self-lubricating copper alloys/% | Corresponding elongation of graphite self-lubricating copper alloys/% |
| 34 | 96 | 95 | 110 | 116 |
| 35 | 97 | 95 | 108 | 114 |
| 36 | 95 | 94 | 109 | 115 |
| 37 | 95 | 93 | 111 | 117 |
| 38 | 94 | 94 | 110 | 114 |
| 39 | 97 | 96 | 107 | 114 |
| 40 | 97 | 96 | 107 | 113 |

TABLE 5-continued

| Performances in example 34-42 | | | | |
|---|---|---|---|---|
| Example | Corresponding friction coefficient of graphite self-lubricating copper alloys/% | Corresponding wear loss of graphite self-lubricating copper alloys/% | Corresponding tensile strength of graphite self-lubricating copper alloys/% | Corresponding elongation of graphite self-lubricating copper alloys/% |
| 41 | 97 | 97 | 108 | 113 |
| 42 | 97 | 96 | 111 | 116 |

The invention claimed is:

1. A lead-free, high-sulphur and easy-cutting copper-manganese alloy, wherein: the alloy comprises the following components in percentage by weight are Cu 54.0-68.0 wt. %, P 0.001-0.15 wt. %, Sn 0.01-1 wt. %, Mn 1.5-4.0 wt. %, S 0.2-0.6 wt. %; one or more metals other than Zn that have an affinity to sulphur less than the affinity of manganese to sulphur, with the sum of the contents thereof not more than 1.8 wt. %, and the balance being Zn and inevitable impurities, where Pb is not more than 0.05 wt. %; the said metals other than Zn that have an affinity to sulphur less than the affinity of manganese to sulphur are Ni, Fe, W, Co, Mo, Sb, Bi and Nb.

2. The lead-free, high-sulphur and easy-cutting copper-manganese alloy according to claim 1, wherein: the alloy comprises the following components in percentage by weight are Cu 56.0-64.0 wt. %, P 0.001-0.12 wt. %, Sn 0.01-0.8 wt. %, Mn 2.0-3.5 wt. % and S 0.22-0.40 wt. %, one or more metals chosen from Ni, Fe, W, Co, Mo, Sb, Bi and Nb with the sum of the contents thereof not more than 1.5 wt. %, and the balance being Zn and inevitable impurities, where Pb is not more than 0.05 wt. %.

3. The lead-free, high-sulphur and easy-cutting copper-manganese alloy according to claim 2, wherein: the alloy comprises the following components in percentage by weight are Cu 57.0-62.0 wt. %, P 0.001-0.12 wt. %, Sn 0.01-0.6 wt. %, Mn 2.0-3.5 wt. %, S 0.22-0.40 wt. %, Ni 0.1-1.2 wt. %, and the balance being Zn and inevitable impurities, where Pb is not more than 0.05 wt. %.

4. The lead-free, high-sulphur and easy-cutting copper-manganese alloy according to claim 3, wherein: the alloy comprises the following components in percentage by weight are Cu 57.0-62.0 wt. %, P 0.001-0.08 wt. %, Sn 0.01-0.4 wt. %, Mn 2.0-3.5 wt. %, S 0.22-0.30 wt. %, Ni 0.1-0.5 wt. %, and the balance being Zn and inevitable impurities, where Pb is not more than 0.05 wt. %.

* * * * *